US006583547B1

(12) United States Patent
Nakayama et al.

(10) Patent No.: US 6,583,547 B1
(45) Date of Patent: Jun. 24, 2003

(54) CATHODE RAY TUBE WITH UPF TYPE ELECTRON GUN HAVING PARTICULAR ELECTRODE STRUCTURE AND SPACING

(75) Inventors: Toshio Nakayama, Shirako (JP); Yasuo Tanaka, Ichihara (JP); Nobuyuki Suzuki, Ohara (JP); Shoichi Wakita, Chiba (JP); Shoji Shirai, Mobara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

(21) Appl. No.: 09/520,835

(22) Filed: Mar. 8, 2000

(51) Int. Cl.[7] ..... H01J 29/50

(52) U.S. Cl. ..... 313/414; 313/449; 313/460; 313/441

(58) Field of Search ..... 313/414, 409, 313/412, 413, 415, 449, 460, 441, 411

(56) References Cited

U.S. PATENT DOCUMENTS 4,334,170 A * 6/1982 Rockwell ..... 315/16
4,496,877 A * 1/1985 Kueny ..... 315/15
4,942,334 A * 7/1990 Kimmel et al. ..... 313/414
5,077,498 A * 12/1991 Odenthal ..... 315/15
5,216,320 A * 6/1993 Koizumi et al. ..... 313/346 R
5,694,004 A * 12/1997 Kimiya et al. ..... 315/15
5,723,938 A * 3/1998 Kato et al. ..... 313/412
5,814,930 A * 9/1998 Watanabe et al. ..... 313/414
6,031,326 A * 2/2000 Suzuki et al. ..... 313/414
6,288,482 B1 * 9/2001 Watanabe et al. ..... 313/414

FOREIGN PATENT DOCUMENTS

JP 0714200 A * 6/1995
JP 09245662 A * 9/1997
JP 10334824 A * 12/1998
JP 2000215828 A * 8/2000

* cited by examiner

*Primary Examiner*—Vip Patel
*Assistant Examiner*—Kevin Ouarterman
(74) *Attorney, Agent, or Firm*—Antonelli, Terry, Stout & Kraus, LLP

(57) ABSTRACT

A lens structure of a pre-focus part of an Hi-UPF electron gun to be used for a cathode ray tube has a cathode, a control electrode, an acceleration electrode, a first anode, a focus electrode and a second anode arranged in this order. The first anode and the second anode are to be commonly supplied with an anode voltage, and the focus electrode is to be supplied with a focus electrode. In a cathode ray tube of this construction, in the pre-focus part, the control electrode has an electrode beam passage hole of 0.57 mm or smaller and the distance in the vicinity of the electron beam passage hole between the acceleration electrode and the first anode is 1.9 mm or smaller.

29 Claims, 9 Drawing Sheets

| Ik \ φG1 | φ0.65 | φ0.60 | φ0.55 |
|---|---|---|---|
| 0.5 | 0.23 | 0.233 | 0.207 |
| 2 | 0.21 | 0.209 | 0.2 |
| 4 | 0.258 | 0.267 | 0.276 |
| 6 | 0.333 | 0.348 | 0.366 |

| Ik \ φG1 | φ0.65 | φ0.60 | φ0.55 |
|---|---|---|---|
| 0.5 | 0.23 | 0.233 | 0.205 |
| 2 | 0.21 | 0.209 | 0.185 |
| 4 | 0.258 | 0.267 | 0.229 |
| 6 | 0.333 | 0.348 | 0.294 |

| Ik \ φG3 | φ2.20 | φ1.98 |
|---|---|---|
| 0.5 | 0.230 | 0.229 |
| 2 | 0.209 | 0.195 |
| 4 | 0.248 | 0.225 |
| 6 | 0.306 | 0.279 |

| Ik \ TG2 | 0.39 | 0.36 | 0.32 |
|---|---|---|---|
| 0.5 | 0.257 | 0.236 | 0.247 |
| 2 | 0.223 | 0.225 | 0.239 |
| 4 | 0.276 | 0.282 | 0.301 |
| 6 | 0.362 | 0.366 | 0.380 |

CATHODE RAY TUBE WITH UPF TYPE ELECTRON GUN HAVING PARTICULAR ELECTRODE STRUCTURE AND SPACING

BACKGROUND OF THE INVENTION

For the large screen TVs exceeding 40 inches, projection TVs are in more widespread use than direct-view Braun tubes. The projection TV projects an image of a Braun tube (PRT) having a nearly 5.5-inch screen onto a screen of about 40 inches by use of an optical lens, mirror, etc. In general, a color image is obtainable by projecting, on a screen, images of three Braun tubes respectively in red, green and blue colors.

For this purpose, a Braun tube called a projection tube (PRT) is used. In the projection type display, a PRT image, for example, of approximately 5.5 inches is projected onto a 40-inch screen, resulting in image magnification of an area as large as 50 times. Due to this, the PRT image is required to be extremely high in brightness and of good focusing quality. For realizing high brightness, a large electron beam current is needed.

The PRT however possesses a problem in that a favorable focusing characteristic must be maintained even when a large current is flowing. Consequently, the PRT generally uses a so-called Hi-UPF electron gun that has a comparatively good focusing characteristic even in a large current region. U.S. Pat. No. 4,178,532 discloses an example of a Hi-UPF type electron gun.

For the PRT, attention has conventionally been paid, principally, to an increase of the main lens aperture. This is for the purpose of maintaining a focusing characteristic even with a large current. In an attempt to further improve performance in the large current region, there is a proposal of a so-called large-aperture electron gun having a main lens with an increased aperture. U.S. Pat. No. 4,271,374 discloses such an electron gun as an example.

Except for a conventional main lens, U.S. Pat. No. 4,318,027 discloses a means to improve focusing in the structure of a pre-focus system. This however concerns use of a BPF electron gun that is different in electron gun structure. Furthermore, as a method of improving focusing, it is possible to increase the size of the electron gun to thereby increase the main lens aperture. This however will require an increase also in the diameter of the tube neck, resulting in side effects, including an increase in the electric power needed for deflection, etc.

SUMMARY OF THE INVENTION

According to the present invention, a focusing characteristic can be improved, which is equivalent to or greater than an increase in the main lens diameter without increasing the tube neck diameter.

A first characteristic of the present invention is, in an Hi-UPF type electron gun, to improve the focusing characteristic in large and small current regions by making a control grid (G1) hole diameter equal to or smaller than ϕ0.57 mm and the distance between an acceleration electrode (G2) and a first anode electrode (G3) equal to or smaller than 1.9 mm.

A second characteristic of the invention is to particularly improve focusing in the large current region by making the G3 hole diameter on a G2 side ϕmm or smaller.

A third characteristic of the invention is to improve the focusing characteristic in the small current region by making the G2 plate thickness 0.37 mm or smaller.

A fourth characteristic of the invention is to obtain an excellent life characteristic by using an oxide containing barium scandate in the cathode.

A fifth characteristic of the invention is to further improve focusing performance drastically by combining the above pre-focus-structured lens structure with a large diameter lens.

DETAILED DESCRIPTION OF THE INVENTION

Figure 1:
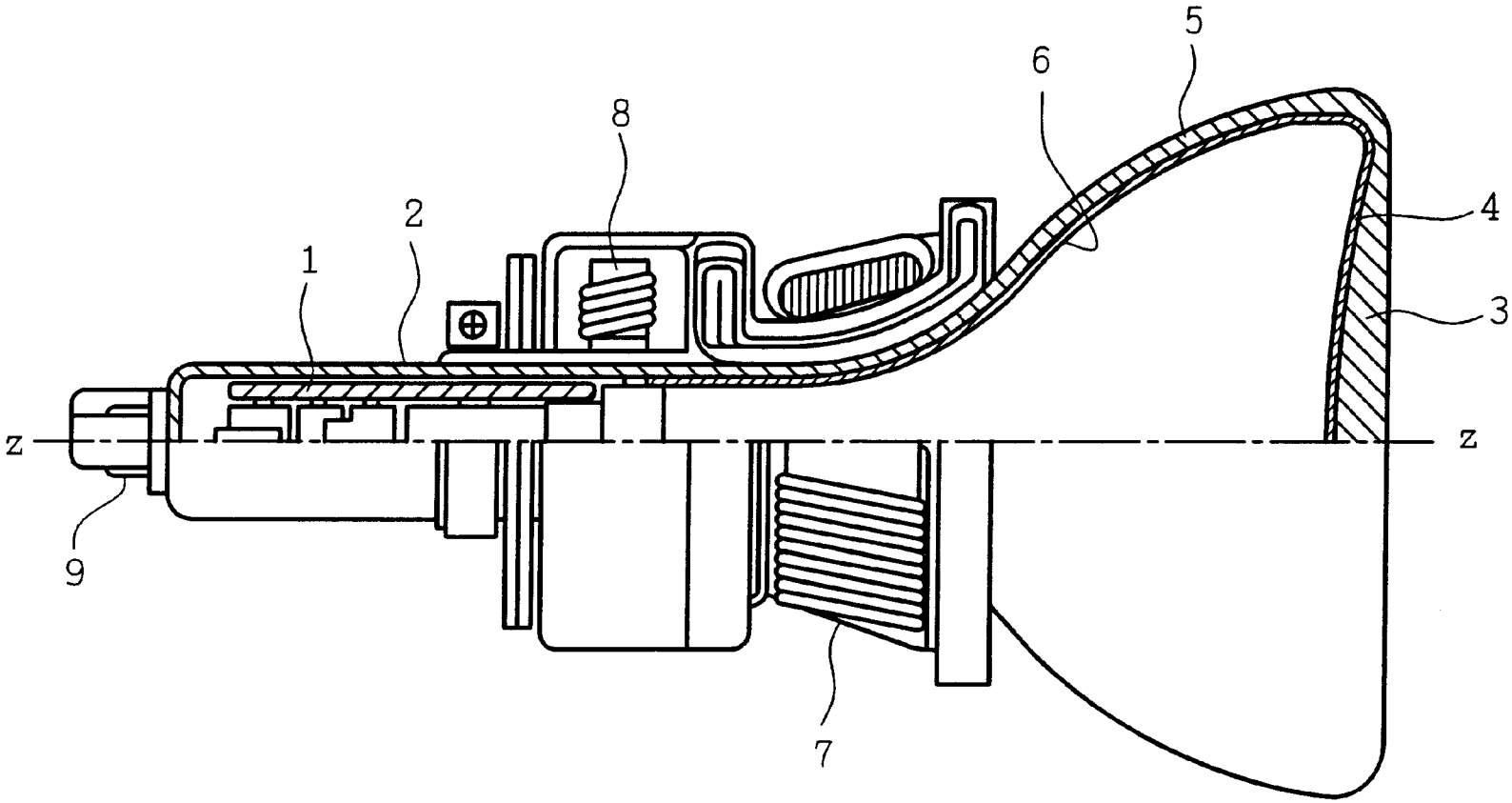
FIG. 1 is a partial sectional view of a PRT.

FIG. 1 is an external view of a PRT. An electron gun 1 accommodated in a neck 2 generates an electron beam. The neck 2 has an external size of ϕ29.1 mm, and the built-in electron gun generates a single beam. Consequently, the PRT has a large electron gun as compared to the usual color Braun tube. This is due to an increase in the main lens aperture. A panel 3 of the tube envelope has an inner surface with a phosphor layer 4 to form a screen having a diagonal size of approximately 5.5 inches. The panel 3 has a structure that is thick in the screen center and thin in the peripheral region. This is because of the need for providing a panel glass with a lens function. A funnel 5 of the tube envelope has an aluminum evaporation film 6 formed in its inner surface. A deflection yoke 7 deflects the electron beam. In the present embodiment, the diagonal deflection angle is 90 degrees. A velocity modulation coil 8 improves the image contrast. Through a terminal 9 there is supplied a voltage to each electrode of the electron gun.

Figure 2:
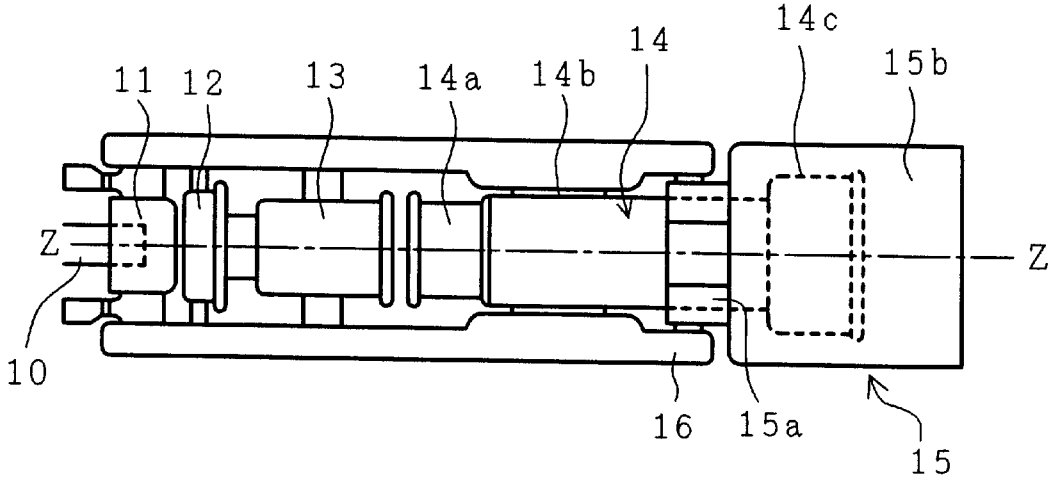
FIG. 2 is a front view of an Hi-UPF type electron gun.
Figure 3:
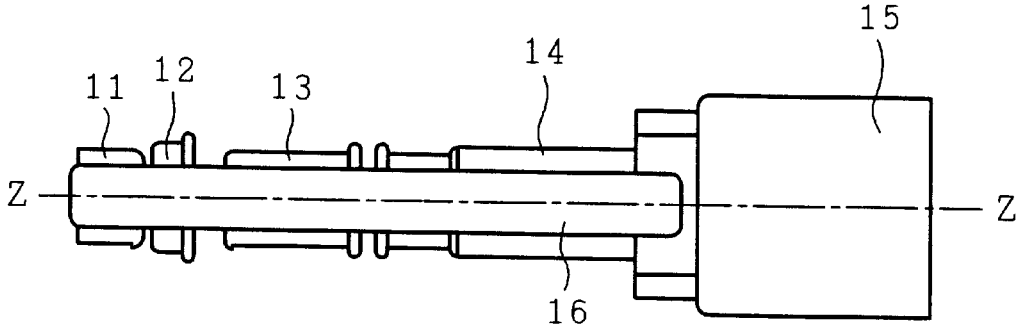
FIG. 3 is a side view of the Hi-UPF type electron gun.

FIG. 2 is a front view of the electron gun of the present invention. Under a typical operating condition, a cathode 10 is supplied with approximately 190 V as an average, a control electrode (G1) 11 is at ground potential, and an acceleration electrode (G2) 12 is supplied with 550 to 600 V. A first anode (G3) 13 is supplied with an anode voltage of 30 kV as a maximum voltage, a focus electrode (G4) 14 is supplied with a focus voltage of approximately 7.7 kV, and a second anode (G5) 15 is supplied with 30 kV as a maximum voltage. The focus electrode G4 has three different outer diameter portions 14*a*, 14*b* and 14*c*. The second anode 15 has two different outer diameter portions 15*a* and 15*b*. A main lens is formed by the largest diameter portion 14*c* of electrode G4 and the largest diameter portion 15*b* of electrode G5. Electrode G4 is inserted in electrode G5 so as to increase the main lens aperture as much as possible for a given neck outer shape. A bead glass 16 is fixed to the electrodes while insulating each electrode. The length of the focus electrode (G4) 14 in the tube axis direction is larger than the length of each of the first anode (G3) 13 and the second anode (G5) 15 in the tube axis direction. FIG. 3 is a side view of the electron gun of the present invention. The same numerals are used to identify the same components as in FIG. 2.

Figure 4:
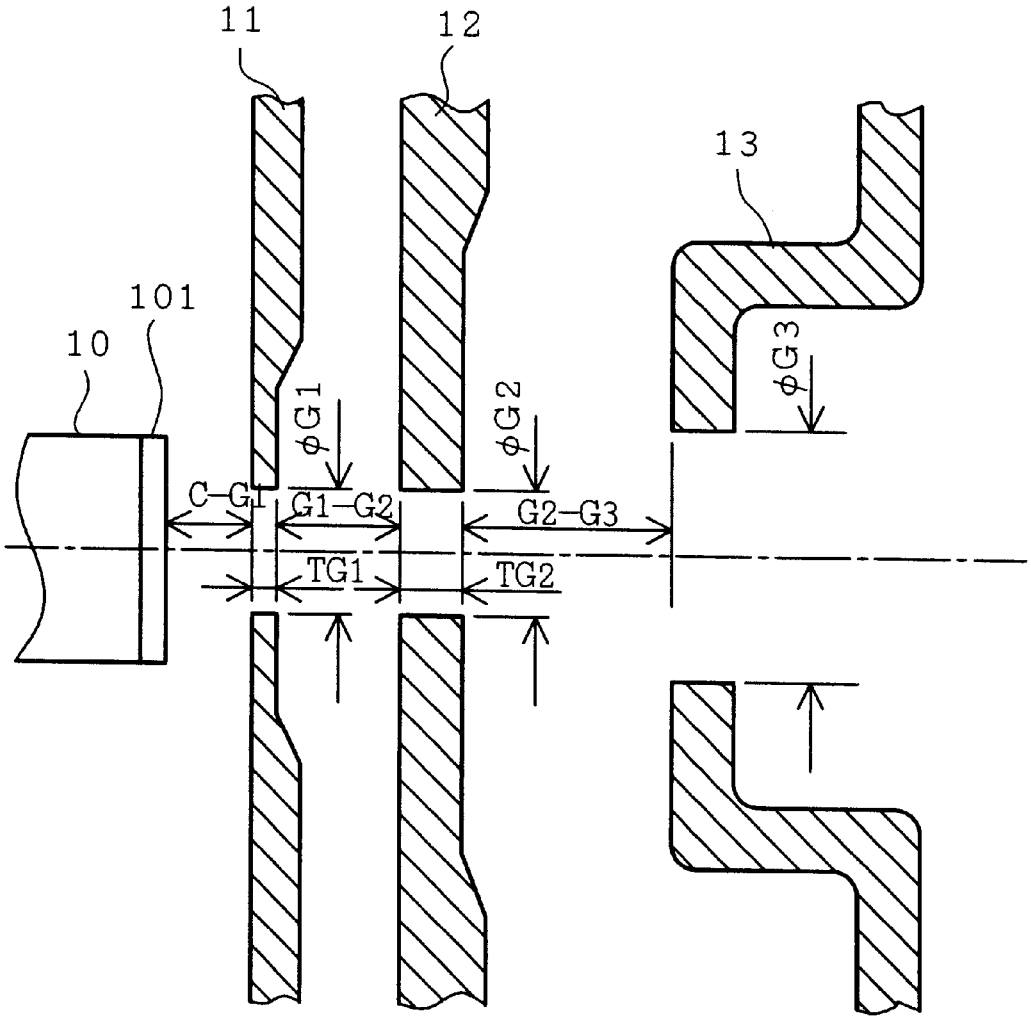
FIG. 4 is a diagram of a pre-focus part of an electron gun.

FIG. 4 is an enlarged view of a pre-focus part of the electron gun. The same numerals are used to identify the same components as in FIG. 2. An oxide layer 101 for electron emission contains barium-scandate. C-G1 is a gap between the cathode and G1, G1-G2 is a gap between G1 and G2, while G2-G3 is a gap between G2 and G3. TG1 indicates the plate thickness of the electrode G1. This plate thickness is provided by reducing the thickness of the material of the electrode G1, e.g. 0.18 mm, through so-called coining. TG2 indicates the plate thickness of the electrode G2. This plate thickness is also provided by somewhat reducing the material thickness, e.g. 0.4 mm, through so-called coining. ϕG1 denotes the G1 hole diameter, ϕG2 denotes the G2 hole diameter, and ϕG3 denotes the G3 bottom hole diameter.

The present inventor has found that the focusing characteristic can be drastically improved over the conventional tube without increase of the neck diameter by optimizing the pre-focus lens system for the Hi-UPF electron gun used in a PRT.

Figures 5A, 5B:
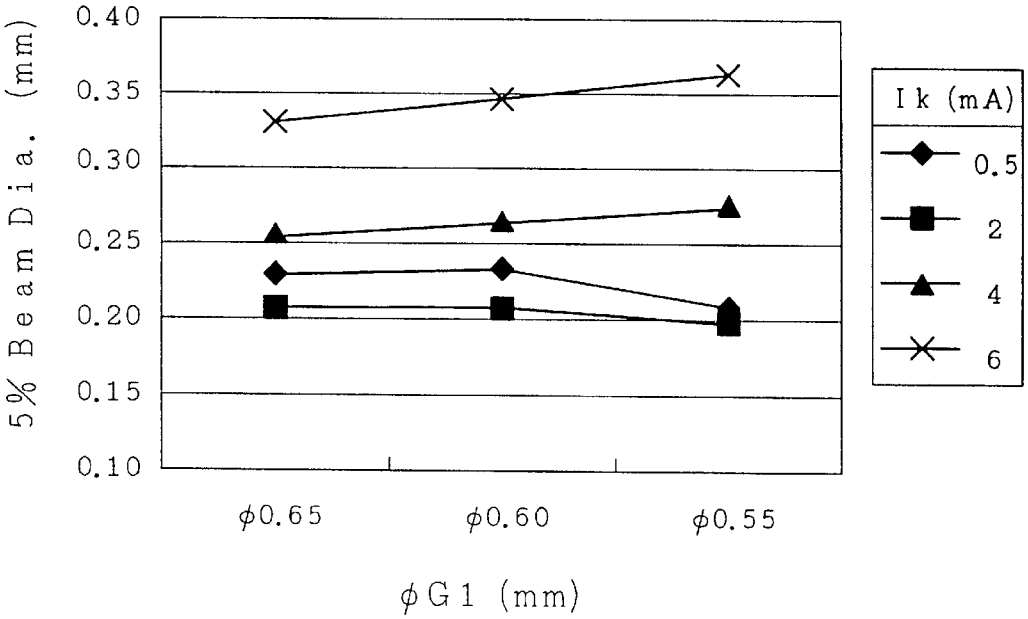
FIG. 5(*a*) is a table and FIG. 5(*b*) is a graph which show a relationship between a G1 hole diameter and a focusing characteristic under a particular condition of the Hi-UPF type electron gun.

FIGS. 5(*a*) and 5(*b*) show the relation between spot size and the G1 hole diameter. The electrode dimensions are different for each G1 hole diameter, as shown in Table 1, to set the cathode cut off voltage at a fixed value. Other electrode dimensions not mentioned in the Table 1 are not changed for each electron gun. The hole diameters of electrode G2 are set to be equal to those of electrode G1.

TABLE 1

| | | | |
|---|---|---|---|
| G1 hole diameter (ϕG1) | ϕ0.65 | ϕ0.60 | ϕ0.55 |
| G1 plate thickness | 0.08 | 0.08 | 0.08 |
| G2 hole diameter (ϕG2) | ϕ0.65 | ϕ0.60 | ϕ0.55 |
| G2 plate thickness | 0.39 | 0.39 | 0.36 |
| gap C–G1 | 0.13 | 0.115 | 0.115 |
| gap G1–G2 | 0.32 | 0.305 | 0.195 |

unit (mm)

In all the tables set forth hereafter, the cathode to G1 distance is measured at the time of electron gun assembling, and is shortened when the cathode Is heated under operation, because of the thermal expansion of the cathode.

It can be seen from FIG. 5(*b*) that the spot size at the small current region (0.5 mA) can be decreased with a reduction of the G1 aperture diameter. When the G1 aperture diameter is less than or equal to 0.57 mm, about a 7% improvement is achieved for the spot diameter.

However, with a reduction in the G1 aperture diameter, the spot diameter in the large current region (6 mA) is increased. To improve the large current region spot diameter, a dimension change, such as a reduction in the G2 to G3 distance, is effective. This kind of dimension change also has a small effect (about 3%) on improving the small current region spot diameter. Therefore, when the G1 aperture diameter is less than or equal to 0.57 mm, a 10% improvement of the spot diameter is possible.

Figure 6:
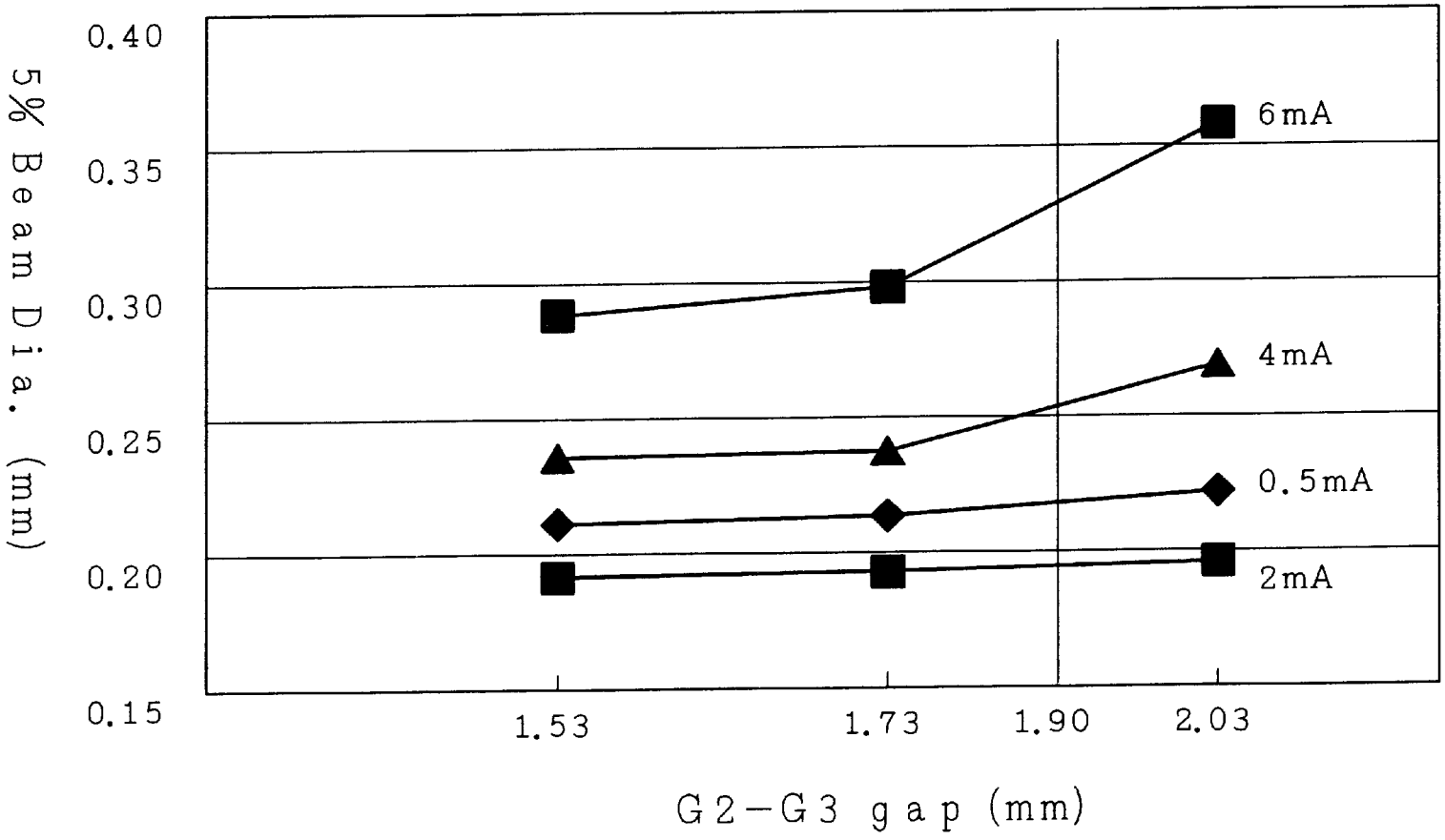
FIG. 6 is a graph which shows the relationship between a spacing G2-G3 and a focusing characteristic in the Hi-UPF type electron gun.

FIG. 6. shows a change of the beam spot diameter where the spacing between G2 and G3 is varied. Although the beam-spot luminance distribution in general is in the form of a bell curve, the beam diameter in the present embodiment has been measured where the luminance is 5% in its peak. This is also true for the embodiments to be given hereunder. The measurement conditions in FIG. 6 are shown in Table 2.

TABLE 2

| | |
|---|---|
| Anode voltage (Eb) | 30 KV |
| Cathode voltage (Ek) | 190 V |
| Focus voltage (EG4) | Just focus at 2 mA |
| G1 hole diameter (ϕG1) | ϕ0.55 mm |
| G2 hole diameter (ϕG2) | ϕ0.55 mm |
| G3 bottom hole diameter (ϕG3) | ϕ1.98 mm |
| gap G1–G2 | 0.275 mm |

It is generally believed that a decrease of the G1 hole diameter improves the focusing characteristics. However, this is true only for a small beam current. For a large current, no expected effect was obtained. Meanwhile, a decrease of the G1 hole diameter increases the cathode loading, causing a problem with the life characteristics. Due to this, it has been a conventional practice to generally use a G1 hole diameter of greater than 0.6 mm.

The present inventor has found that the spacing G2-G3 has a great effect upon improvement of the large-current focusing characteristic. Experiments revealed that, where this value is 1.9 mm or smaller, a conspicuous effect is obtainable in a large current region. FIG. 6 shows that when the G2 to G3 distance is set to an appropriate value, the spot diameter in the large current region can be reduced significantly without sacrificing the effect of reduction of the G1 hole diameter for decreasing the lower current region spot diameter. Therefore, the spot diameter improvement effect obtained by the G1 hole diameter reduction is worth the risk caused by the increase of the cathode current density (cathode loading) which results from the reduction.

Combining the effects shown in the FIG. 5(*b*) and FIG. 6, it is found that reduction of the spot sizes over 10% at both the higher and lower current regions compared with those of the conventional PRT is possible, when the G2 to G3 distance and the G1 hole diameter are less than or equal to 1.9 mm and 0.57 mm, respectively.

Also, FIG. 6 shows that focusing in the large current region is improved by decreasing the gap G2-G3, but there is a tendency that the characteristic improvement becomes saturated if the gap G2-G3 is smaller than 1.73 mm. The UPF electron gun has a feature of applying a high voltage of nearly 30 kV between electrodes G2 and G3. This results in an extremely severe breakdown voltage characteristic. FIG. 6 implies that the gap G2-G3 is advantageously 1.5 mm or greater, because the focusing characteristic improvement is slight if it is 1.5 mm or smaller.

Figures 7A, 7B:
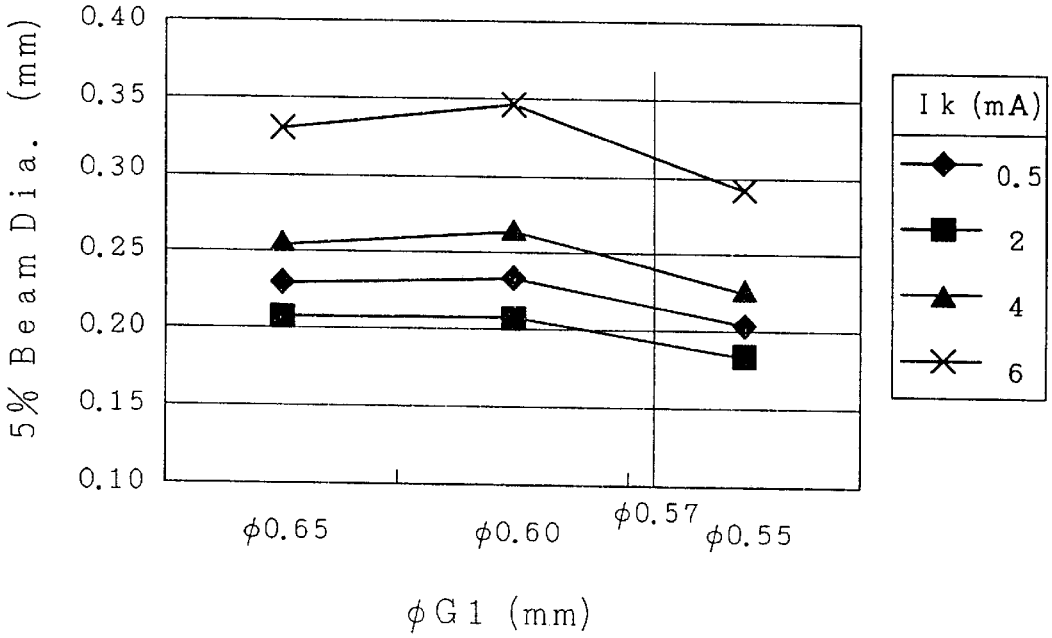
FIG. 7(*a*) is a table and FIG. 7(*b*) is a graph which show a relationship between a G1 hole diameter and a focusing characteristic under another condition of the Hi-UPF type electron gun.

FIGS. 7(*a*) and 7(*b*) show a focusing characteristic wherein the G1 hole diameter is varied while varying the G3 bottom hole diameter. It can be understood that the change of the G3 bottom hole diameter provides a drastic change in the focusing characteristic as compared to the case of FIG. 6. Meanwhile, FIG. 7(*b*) shows that G1 of 0.57 mm or smaller provides a conspicuous improvement in the focusing characteristic. The principal conditions for FIG. 7(*b*) are shown as in Table 3. The focus voltage is adjusted such that just focusing is attained at a cathode current Ik of 2 mA.

TABLE 3

| | | | |
|---|---|---|---|
| G1 hole diameter (ϕG1) | ϕ0.65 | ϕ0.60 | ϕ0.55 |
| G1 plate thickness | 0.08 | 0.08 | 0.07 |
| G2 hole diameter (ϕG2) | ϕ0.65 | ϕ0.60 | ϕ0.55 |
| G2 plate thickness | 0.39 | 0.39 | 0.36 |
| G3 bottom diameter (ϕG3) | ϕ2.2 | ϕ2.2 | ϕ1.98 |
| gap C–G1 | 0.13 | 0.115 | 0.115 |
| gap G1–G2 | 0.32 | 0.305 | 0.195 |

unit (mm)

Figures 8A, 8B:
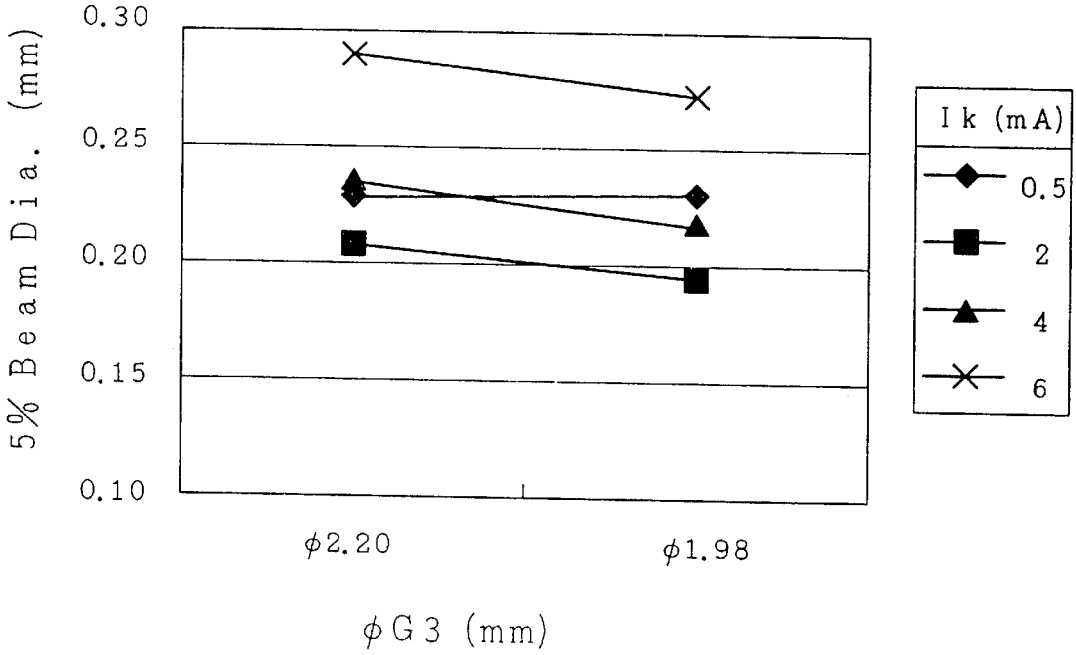
FIG. 8(*a*) is a table and FIG. 8(*b*) is a graph which a show relationship between a G3 bottom hole diameter and a focusing characteristic.

FIGS. 8(*a*) and 8(*b*) show a relationship between a G3 bottom hole diameter and a focusing characteristic where the gap G2-G3 is 1.53 mm. In this region as well, conspicuous dependency is seen on the focusing characteristic on the G3 bottom hole diameter. The other conditions are as shown in Table 4. The focus voltage is adjusted such that just focusing is attained at a cathode current Ik of 2 mA.

TABLE 4

| | |
|---|---|
| G1 hole diameter | ϕ0.54 |
| G1 plate thickness | 0.08 |
| G2 hole diameter (ϕG2) | ϕ0.55 |
| G2 plate thickness | 0.36 |
| gap C–G1 | 0.105 |
| gap G1–G2 | 0.275 |
| gap G2–G3 | 1.53 |

unit (mm)

From FIGS. 6, 7(*b*) and 8(*b*), it is confirmed that, if the G3 bottom hole diameter is ϕ2.0 mm or smaller, the focusing characteristic is improved particularly in the large current region. It should be noted that there is a spread of the electron beam in the neighborhood of the G3 bottom. If the center of the G3 bottom hole deviates from the center of the electron beam, a phenomenon occurs in which the electron beam hits the electrode G3. In order to prevent this, the G3 bottom hole diameter is desirably ϕ1.5 mm or greater in consideration of the accuracy of assembling the electron gun.

Figures 9A, 9B:
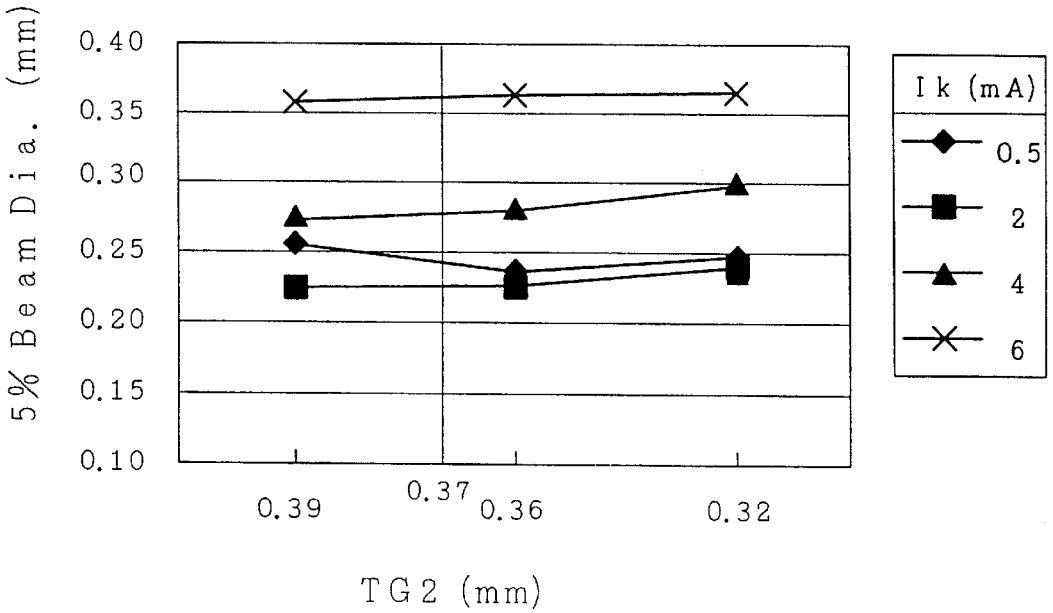
FIG. 9(*a*) is a table and FIG. 9(*b*) is a graph which show a relationship between a G2 plate thickness and a focusing characteristic.

FIGS. 9(*a*) and 9(*b*) show a relationship between a G2 plate thickness TG2 and a focusing characteristic. FIG. 9 shows that a G2 plate thickness TG2 of 0.37 mm or smaller improves the focusing characteristic in the low current region, particularly when the cathode current Ik is 0.5 mA. However, there is observed a tendency under this condition that if the G2 plate thickness TG2 is 0.32 mm or smaller, the focusing characteristic deteriorates in the large current region. Accordingly, the G2 plate thickness TG2 is desirably 0.32 mm or greater. The other conditions are shown in Table 5.

TABLE 5

| | |
|---|---|
| G1 hole diameter (ϕG1) | ϕ0.55 |
| G1 plate thickness | 0.08 |
| G2 hole diameter (ϕG2) | ϕ0.55 |
| gap C–C1 | 0.115 |
| gap G1–G2 | 0.255 |
| gap G2–G3 | 1.73 |

unit (mm)

Figure 10:
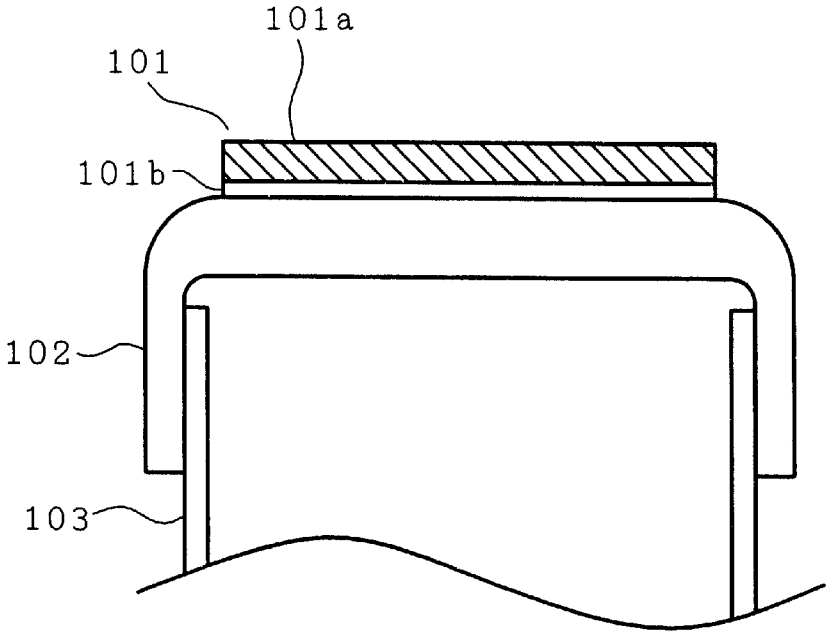
FIG. 10 is a diagram of the structure in the vicinity of a cathode.

FIG. 10 is a typical view of a cathode used in the present embodiment. An oxide layer 101 is divided into two layers. The lower layer 101*b* is formed of a usual oxide and the upper layer 101*a* is formed of an oxide containing approximately 1.4 wt % of barium scandate. Incidentally, it is effective when the content of barium scandate is 0.3 wt %–2 wt %. In the present embodiment, the lower layer has a thickness of 20 μm and the upper layer has a thickness of 48 μm. The oxide containing barium scandate has a feature capable of withstanding a high cathode loading. The lower layer is formed of the usual oxide mainly because it provides good adhesion to a cathode cap 102 made principally of Ni. A cathode sleeve 103 is formed of an Ni—Cr alloy having a thickness of approximately 25 μm.

In the PRT of the present invention, the focusing characteristic was improved over the conventional PRT by 17% in the small current region (at a cathode current Ik=0.5 mA), 18% In-the middle current region (at Ik=2.0 mA) and 21% in the large current region (at Ik=6.0 mA). An electron gun used in the PRT having such a characteristic has the dimensions as shown in Table 6.

TABLE 6

| | |
|---|---|
| G1 hole diameter (ϕG1) | ϕ0.54 |
| G1 plate thickness | 0.07 |
| G2 hole diameter (ϕG2) | ϕ0.55 |
| G2 plate thickness | 0.36 |
| gap C–G1 | 0.105 |
| gap G1–G2 | 0.235 |
| gap G2–G3 | 1.73 |
| Main lens | large-aperture main lens shown in Fig. 2 |

unit (mm)

Figure 11:
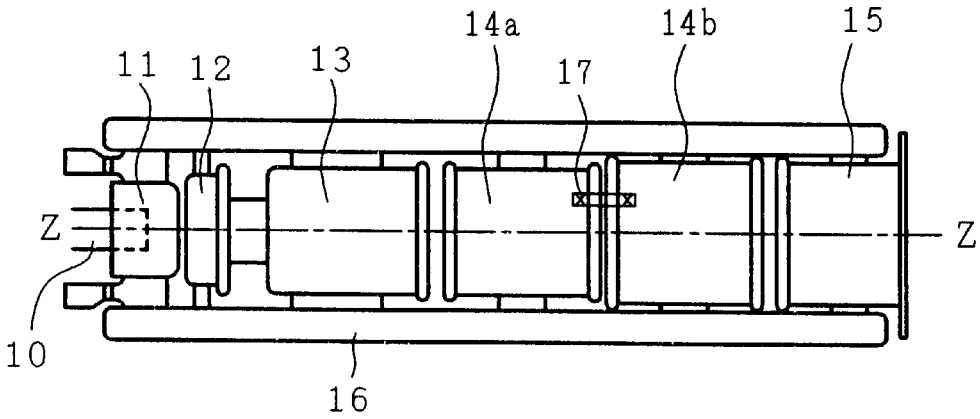
FIG. 11 is a diagram of another Hi-UPF type electron gun.

Although the embodiments described heretofore were directed to electron guns having a large aperture with a focus electrode G4 inserted in the second anode G5, the invention is also applicable to a usual Hi-UPF electron gun as shown in FIG. 11. In FIG. 11, the same electrodes as in the previously described embodiments are denoted by the same reference numerals. In FIG. 11, the focus electrode is divided into two elements, i.e. 14*a* and 14*b*, which are electrically connected through a metal strap 17. A main lens is formed by the second anode 15 and the focus electrode 14*b*. In the FIG. 11 example, the focus electrode 14*b* is somewhat greater than 14*a*. This is for the purpose of increasing the main lens aperture as much as possible.

Although the above explanation was directed to a PRT requiring a severe focusing performance, the invention is not limited to such a PRT, but is applicable also to a color Braun tube of a three-electron-gun type using Hi-UPF electronic guns.

What is claimed is:

1. In a cathode ray tube having an envelope comprising a panel part having a fluorescent screen, a neck part incorporating an electron gun, and a funnel part joining said panel part and said neck part, the cathode ray tube being characterized in that:

said electron gun has a cathode, a control electrode, an acceleration electrode, a first anode, a focus electrode and a second anode arranged in this order in a direction toward said fluorescent screen; said first anode and said second anode to be commonly supplied with an anode voltage; said focus electrode to be supplied with a focus voltage, a length of said focus electrode in a tube axis direction being larger than a length of said first anode in the tube axis direction; said control electrode and said first anode in their portions facing said acceleration electrode and said acceleration electrode having electron beam passage holes; the electron beam passage hole of said control electrode having a diameter which is equal to or smaller than 0.57 mm; and said acceleration electrode and said first anode in the vicinity of the outer periphery of their electron beam passage holes being spaced by a distance of 1.9 mm or less.

2. A cathode ray tube according to claim 1, wherein the diameter of the beam passage hole in said control electrode is equal to greater than 0.50 mm and equal to or smaller than 0.57 mm.

3. A cathode ray tube according to claim 1, wherein said acceleration electrode and said first anode in the vicinity of an outer periphery of their electron beam passage holes are spaced by a distance of equal to or greater than 1.5 mm and equal to or smaller than 1.9 mm.

4. A cathode ray tube according to claim 1, wherein electron beam passage hole of said first anode has a diameter of equal to or smaller than 2.0 mm.

5. A cathode ray tube according to claim 4, wherein electron beam passage hole of said first anode has a diameter of equal to or greater than 1.5 mm and equal to or smaller than 2.0 mm.

6. A cathode ray tube according to claim 1, wherein said acceleration electrode in the vicinity of said electron beam passage hole has a plate thickness which is equal to or smaller than 0.37 mm.

7. A cathode ray tube according to claim 6, wherein said acceleration electrode in the vicinity of said electron beam passage hole has a plate thickness which is equal to or greater than 0.32 mm and equal to or smaller than 0.37 mm.

8. A cathode ray tube according to claim 1, wherein said cathode has an oxide on a cathode top surface, said oxide having an upper layer containing barium scandate.

9. A cathode ray tube according to claim 8, wherein said upper surface of said oxide contain 0.3 wt % to 2.0 wt % of barium scandate.

10. A cathode ray tube according to claim 1, wherein the electron beam passage hole in said acceleration electrode has a hole diameter which is generally the same as the hole diameter of the electron beam passage hole in said control electrode.

11. In a cathode ray tube having an envelope comprising a panel part having a fluorescent screen, a neck part incorporating an electron gun for generating a single electron beam, and a funnel part joining said panel part and said neck part, the cathode ray tube being characterized in that:

said electron gun has a cathode, a control electrode, an acceleration electrode, a first anode, a focus electrode and a second anode arranged in this order in a direction toward said fluorescent screen; said first anode and said second anode to be commonly supplied with an anode voltage; said focus electrode being to be applied with a focus voltage, a length of said focus electrode in a tube axis direction being larger than a length of said first anode in the tube axis direction; said control electrode and said first anode in their portions facing said acceleration electrode and said acceleration electrode having electron beam passage holes; the electron beam passage hole of said control electrode having a diameter which is equal to or smaller than 0.57 mm; and said acceleration electrode and said first anode in the vicinity of the outer periphery of their electron beam passage holes being spaced by a distance of 1.9 mm or less.

12. A cathode ray tube according to claim 11, wherein said panel at the screen center has a glass wall thickness greater than a screen peripheral wall thickness to thereby form an optical lens.

13. A cathode ray tube according to claim 11, wherein the diameter of the beam passage hole in said control electrode is equal to or greater than 0.50 mm and equal to or smaller than 0.57 mm.

14. A cathode ray tube according to claim 11, wherein said acceleration electrode and said first anode in the vicinity of an outer periphery of their electron beam passage holes are spaced by a distance of equal to or greater than 1.5 mm and equal to or smaller than 1.9 mm.

15. A cathode ray tube according to claim 11, wherein the electron beam passage hole of said first anode has a diameter of equal to or smaller than 2.0 mm.

16. A cathode ray tube according to claim 15, wherein the electron beam passage hole of said first anode has a diameter of equal to or greater than 1.5 mm and equal to or smaller than 2.0 mm.

17. A cathode ray tube according to claim 11, wherein said acceleration electrode in the vicinity of said electron beam passage hole has a plate thickness which is equal to or smaller than 0.37 mm.

18. A cathode ray tube according to claim 17, wherein said acceleration electrode in the vicinity of said electron beam passage hole has a plate thickness which is equal to or greater than 0.32 mm and equal to or smaller than 0.37 mm.

19. A cathode ray tube according to claim 11, wherein said cathode has an oxide on a cathode top surface, said oxide having an upper layer containing barium scandate.

20. A cathode ray tube according to claim 19, wherein said upper surface of said oxide contain 0.3 wt % to 2.0 wt % of barium scandate.

21. A cathode ray tube according to claim 11, wherein the electron beam passage hole in said acceleration electrode has a diameter which is generally same as the diameter of the electron beam passage hole in said control electrode.

22. A cathode ray tube according to claim 11, wherein said focus electrode has a tip which is inserted in said second anode to provide a structure forming a main lens in said second anode.

23. A cathode ray tube according to claim 22, wherein said focus electrode has three different outer diameter portions with a largest diameter portion being provided on said panel side, said second anode has two different outer diameter portions with a largest diameter portion being provided on said panel side, said main lens is formed within said largest diameter portion of said focus electrode and in said largest diameter portion of said second anode.

24. A cathode ray tube according to claim 1, wherein the length of said focus electrode in the tube axis direction is larger than a length of said second anode in the tube axis direction, and the electron beam passage hole of said control electrode has a diameter of 0.57 mm.

25. A cathode ray tube according to claim 1, wherein the anode voltage is 30 kV.

26. A cathode ray tube according to claim 1, wherein the distance of the spacing of said acceleration electrode and said first anode in the vicinity of their electron beam passage holes is in a range of greater than 1.5 mm to 1.9 mm.

27. A cathode ray tube according to claim 11, wherein the length of said focus electrode in the tube axis direction is larger than a length of said second anode in the tube axis direction, and the electron beam passage hole of said control electrode has a diameter of 0.57 mm.

28. A cathode ray tube according to claim 11, wherein the anode voltage is 30 kV.

29. A cathode ray tube according to claim 11, wherein the distance of the spacing of said acceleration electrode and said first anode in the vicinity of their electron beam passage holes is in a range of greater than 1.5 mm to 1.9 mm.

* * * * *